US005601120A

United States Patent [19]

Kuckart et al.

[11] Patent Number: 5,601,120

[45] Date of Patent: Feb. 11, 1997

[54] PIN SEAM WITH DOUBLE END LOOPS AND METHOD

[75] Inventors: Stephanie Kuckart, Selterschlag; Gisela Fickers, Windmühlenweg; Ernst Schröder, Rotterweg, all of Belgium

[73] Assignee: Asten, Inc., Charleston, S.C.

[21] Appl. No.: 594,267

[22] Filed: Jan. 30, 1996

[51] Int. Cl.[6] ..... D03D 13/00; D03D 15/00

[52] U.S. Cl. ..... 139/383 AA

[58] Field of Search ..... 139/383 AA; 264/258; 24/33 P, 33 C, 573.7; 28/141

[56] References Cited

U.S. PATENT DOCUMENTS

| | | | |
|---|---|---|---|
| 3,474,507 | 10/1969 | Thompson . | |
| 3,546,330 | 12/1970 | Thompson . | |
| 3,565,711 | 2/1971 | Block et al. . | |
| 4,186,780 | 2/1980 | Josef et al. | 139/383 AA |
| 4,329,079 | 5/1982 | Milding | 24/573.7 |
| 4,469,142 | 9/1984 | Harwood . | |
| 4,695,498 | 9/1987 | Sarrazin et al. . | |
| 4,775,446 | 10/1988 | Eschmann | 139/383 AA |
| 4,824,525 | 4/1989 | Penven . | |
| 4,846,231 | 7/1989 | Penven . | |
| 4,862,926 | 9/1989 | Barrette et al. . | |
| 4,883,096 | 11/1989 | Penven . | |
| 5,092,373 | 3/1992 | Lee . | |
| 5,117,865 | 6/1992 | Lee . | |
| 5,167,262 | 12/1992 | Bennett et al. . | |
| 5,230,371 | 7/1993 | Lee . | |
| 5,343,896 | 9/1994 | Schroder et al. . | |
| 5,391,419 | 2/1995 | Davenport . | |
| 5,411,062 | 5/1995 | Lee . | |

*Primary Examiner*—Andy Falik
*Attorney, Agent, or Firm*—Volpe and Koenig, P.C.

[57] ABSTRACT

A papermakers fabric has concentric double pin seam loops on each end for enabling it to be seamed to form an endless form for use on a papermaking machine. A seaming method for making double seaming loops is also provided.

27 Claims, 7 Drawing Sheets

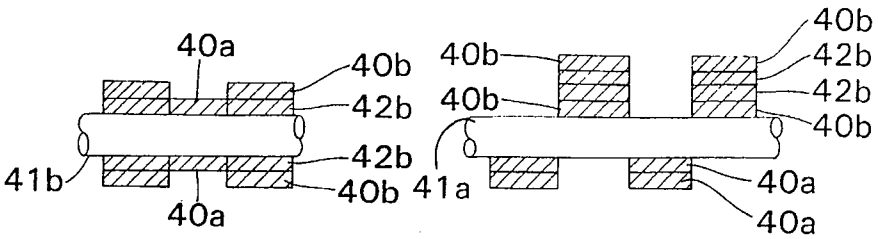
Fig. 11
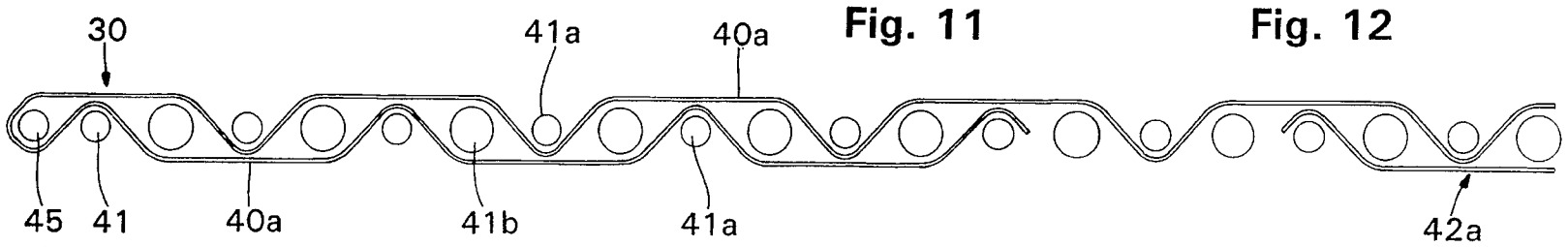
Fig. 12
Fig. 9a
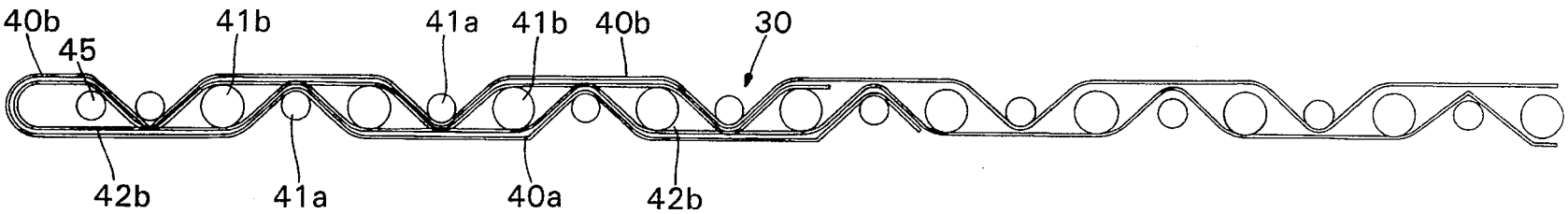
Fig. 9b
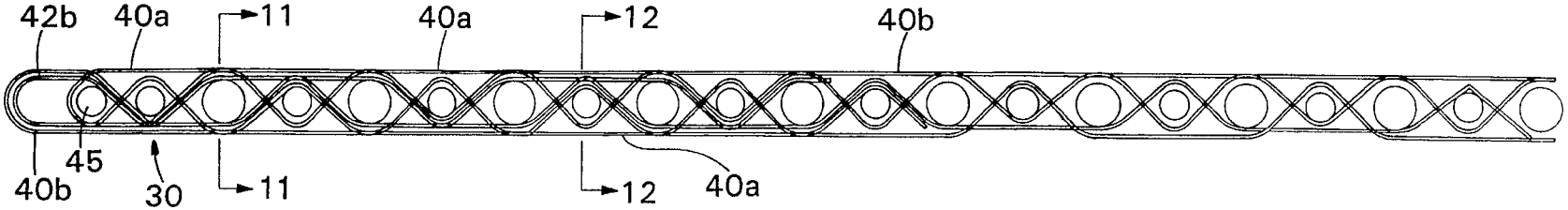
Fig. 10

PIN SEAM WITH DOUBLE END LOOPS AND METHOD

BACKGROUND OF THE INVENTION

1. Field of the Invention

The present invention relates to seams for industrial fabrics, such as papermakers fabrics and a seaming method.

2. Description of Related Art

When used on papermaking equipment, papermakers fabrics are configured as endless belts to form and/or transport a paper product as it is made. Woven papermakers fabrics are made by either conventional flat or endless weaving. With flat woven fabrics, the warp yarns are oriented in the machine direction of the papermaking equipment on which the fabric is used. With endless woven fabrics, the weft yarns are oriented in the machine direction during usage.

Endless weaving techniques may be used to weave a seamless papermakers fabrics. However, there are practical limitations on the overall size of endless woven fabrics as well as inherent installation difficulties. Moreover, not all papermaking equipment is designed to accept the installation of an endless woven seamless fabric. Consequently, both endless and flat woven papermakers fabrics are often supplied having opposing ends which are joined during installation of the fabric on papermaking equipment.

A variety of seaming techniques are well known in the art. One conventional method of seaming is to form alternating machine direction yarns on each end of the fabric into a series of loops. The loops of the respective fabric ends are then intermeshed during fabric installation to define a channel through which a pintle is inserted to lock the ends together.

For example, U.S. Pat. Nos. 4,206,331; 4,438,789; 4,469,142; 4,846,231; 4,824,525; and 4,883,096 disclose a variety of pin seams wherein the machine direction yarns are utilized to form the end loops. In each of those patents, individual machine direction yarns are woven back into the fabric to form a series of single loops. However, the loops of such seams are prone to stretching and fraying which may compromise the strength of the endless belt. The seam is typically the weak point of the installed fabric and may fail after repeated usage on modern high speed papermaking equipment.

It would be desirable to provide a papermakers fabric with reinforced machine direction seaming loops with increased structural stability. It would also be desirable to have a fabric with reinforced seaming loops without significantly increasing the bulk or thickness of the fabric at the seam.

SUMMARY OF THE INVENTION

The present invention provides a papermakers fabric having a system of machine direction yarns (hereinafter MD yarns) which are used to form a series of seaming loops on opposing fabric ends. With respect to at least some of the loops, a second loop is formed, either from a woven MD yarn or a pre-crimped MD yarn segment, to create nested loop pairs, i.e. double loops.

In the preferred embodiment, the fabric is flat woven with at least two stacked layers of flat monofilament MD yarns, and at least one layer of cross machine direction yarns (hereinafter CMD yarns). After the fabric is woven and heat set, the fabric is trimmed to a desired length. CMD yarns are then removed from each end to result in crimped MD yarn end portions projecting from each end of the fabric. Proceeding across the fabric, two end portions from every other group of stacked MD yarns are looped back upon themselves and rewoven into the fabric end to form a pair of nested orthogonal end loops, i.e., a double loop. Where there are more than two MD yarns in each group of stacked yarns, the non-loop forming yarns are trimmed back to vacate space used for the backweaving of loop forming MD yarns.

Alternatively, pre-crimped yarn segments are backwoven into the end of the fabric to form inner loops. A single MD yarn is then looped back around each of the inner loops an backwoven into the fabric to form an outer loop of a nested loop pair.

With respect to the alternate groups of stacked MD yarns which are not used to form the end loops, all but a single MD yarn of each stacked MD yarn group are trimmed back. The single untrimmed projecting MD yarn end portions are then backwoven into the fabric to retain the endmost remaining CMD yarns, preferably in space vacated by trimming one of the other stacked MD yarns.

It is the object of the invention to provide a fabric constructed of all monofilament yarns with double end loops which increase strength and durability of the fabric.

Other objects and advantages will become apparent to those skilled in the art after reading the detailed description of a presently preferred embodiment.

BRIEF DESCRIPTION OF DRAWINGS

FIGS. 9*a* and 9*b* are schematic views of a third embodiment of the double loop pin seam fabric showing the non-loop forming MD yarns and loop forming MD yarns, respectively.

FIG. 10 is a composite view of the fabric depicted in FIG. 9*a* and 9*b*.

FIG. 11 is a cross sectional view along line 11—11 in FIG. 10.

FIG. 12 is a cross sectional view along line 12—12 in FIG. 10.

DETAILED DESCRIPTION OF THE PREFERRED EMBODIMENT

Figure 1A:
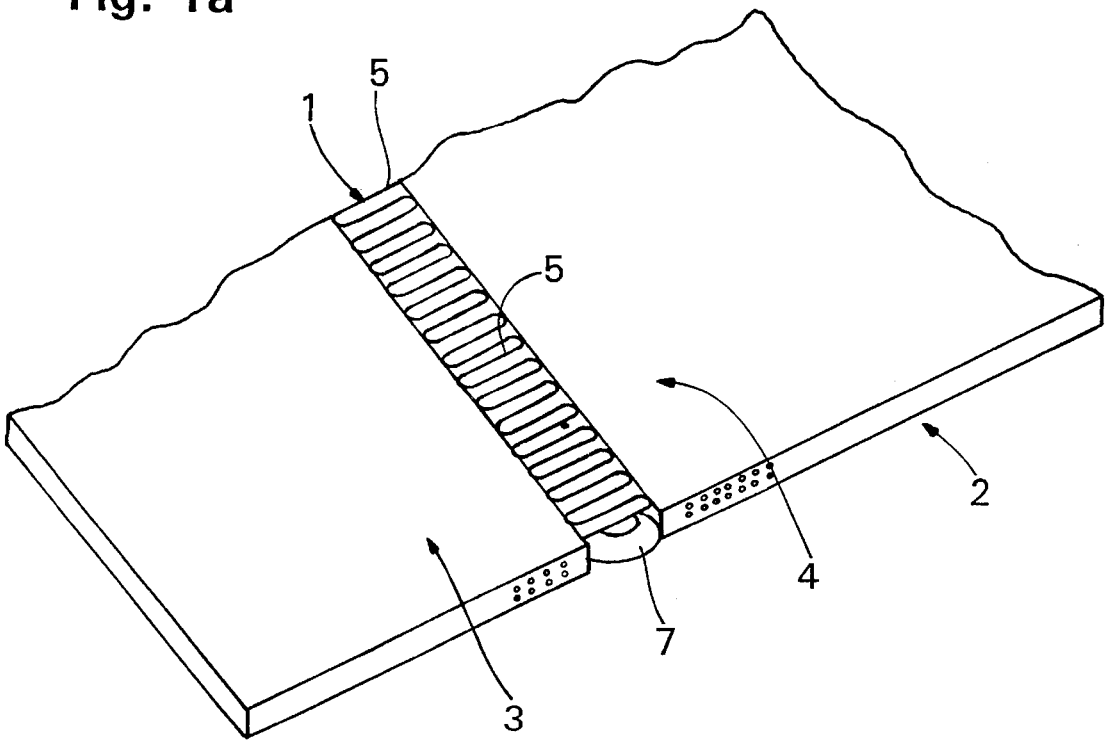
FIG. 1*a* is a perspective view of a papermakers fabric incorporating a double loop pin seam in accordance with the teachings of the present invention.
Figure 1B:
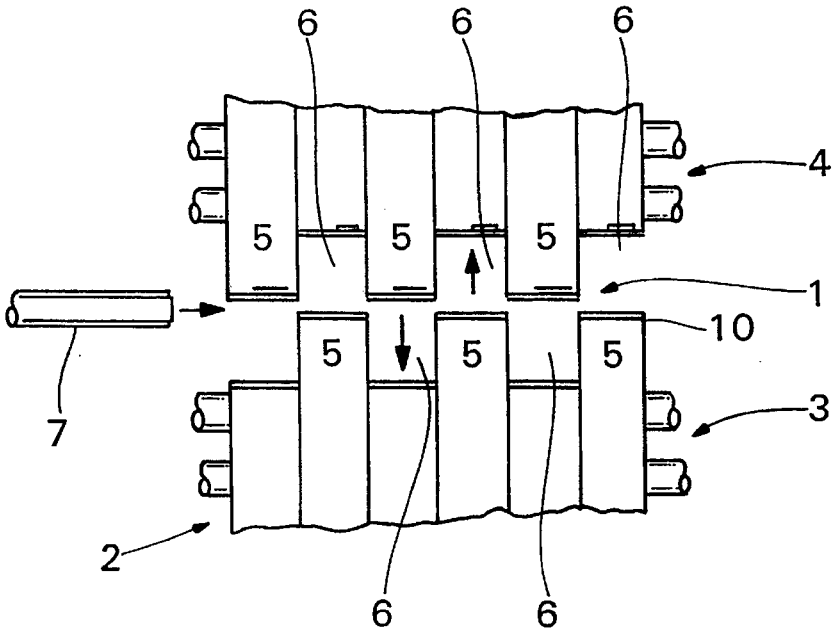
FIG. 1*b* is a top view of opposing ends of the double loop pin seam prior to being secured by a pintle member.

Referring to FIGS. 1*a* and 1*b*, there is shown a pin seam 1 for a papermakers fabric 2. Each of the fabric ends 3 and 4 include a series of alternating loops 5 and spaces 6 formed by machine direction (MD) yarns to connect the fabric 3 and 4 ends. Alternating loops 5 from each end of the fabric are intermeshed to form a channel, and a pintle 7 is inserted through the channel to retain the fabric ends 3 and 4 together in a substantially continuous endless structure.

Figure 2:
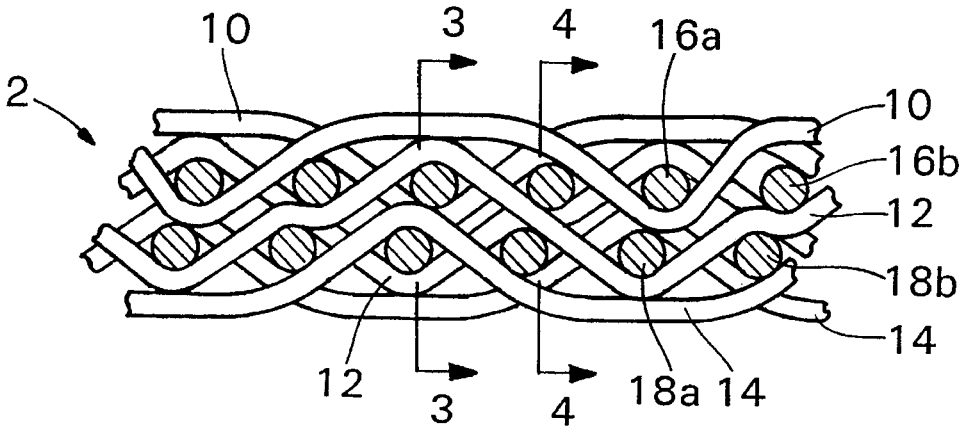
FIG. 2 is a schematic view of the preferred embodiment of the body of a fabric on which the double looped end is formed.
Figure 3:
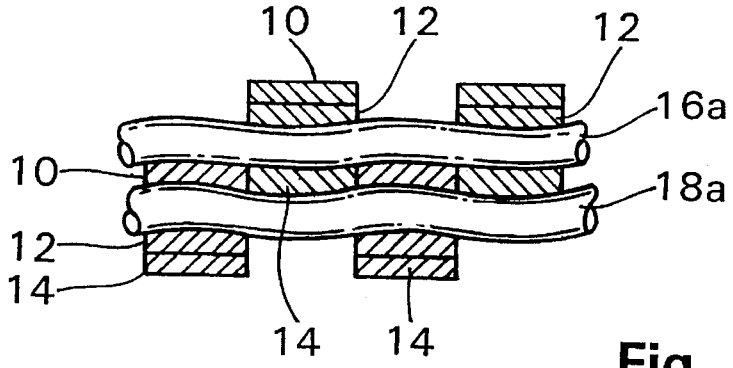
FIG. 3 is a cross sectional view along lines 3—3 in FIG. 2.
Figure 4:
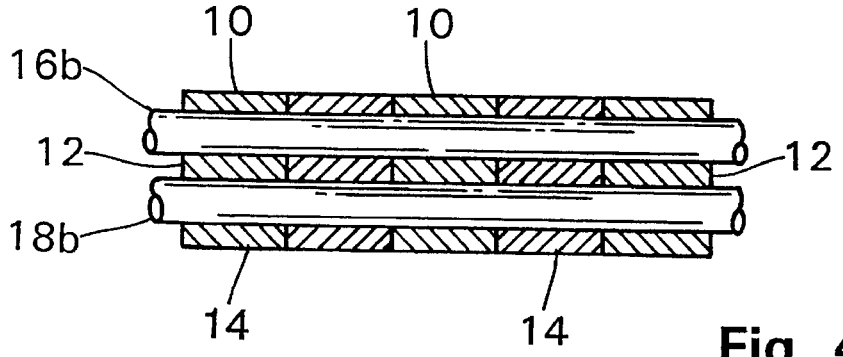
FIG. 4 is a cross sectional view along line 4—4 in FIG. 2.

As illustrated in FIGS. 2–4, the papermakers fabric 2 is preferably woven with three layers of flat monofilament MD yarns 10, 12, 14 and two layers of cross machine direction (CMD) yarns 16*a,b* and 18*a,b*. The MD yarns 10, 12, 14 weave knuckles about alternate CMD yarns 16*a*, 18*a* such that the alternate CMD yarns 16*a*, 18*a* are crimped significantly more than the other CMD yarns 16*b*, 18*b*.

The MD yarn layers define stacked triplet groups of MD yarns comprising upper MD yarns 10, intermediate MD yarns 12 and lower MD yarns 14. The upper MD yarns 10 weave with upper CMD yarns 16*a,b* in a float over three upper layer CMD yarns 16*a,b*, under the next yarn 16*a* to form a single knuckle, and thereafter rise to the top surface to continue to repeat. Similarly, the lower MD yarns 14 weave with lower CMD yarns 18*a,b* in an inverted image of the upper MD and CMD yarns. Lower MD yarns 14 weave under three lower layer CMD yarns 18*a,b*, over the next CMD yarn 18*a* forming a knuckle, then return to the bottom surface of the fabric to repeat. Preferably, the knuckle formed by the upper MD yarns 10 is disposed above the middle of the float defined by the lower MD yarns 14 and vice versa.

The intermediate layer MD yarns 12 interweave with both the upper and lower CMD yarns 16*a,b*, 18*a,b*. Preferably, intermediate MD yarn 12 weaves under the lower CMD yarn 18*a* which is directly beneath the knuckle defined by upper MD yarn 10, weaves between the next CMD yarns 16*b*, 18*b*, weaves over the next CMD yarn 16*a* directly above the knuckle defined by lower MD yarn 14, weaves between the next CMD yarns 16*b*, 18*b* and thereafter repeats. Although the repeat of the upper, intermediate and lower MD yarns 10, 12, 14 is with respect to four pairs of upper and lower CMD yarns 16*a,b*, 18*a,b*, respectively, the upper and lower MD yarns 10, 14 weave knuckles with respect to only every other pair of CMD yarns 16*a*, 18*a*, respectively, such that every other stacked triplet of MD yarns weaves in the same manner with the same CMD yarns across the width of the fabric.

Figure 5:
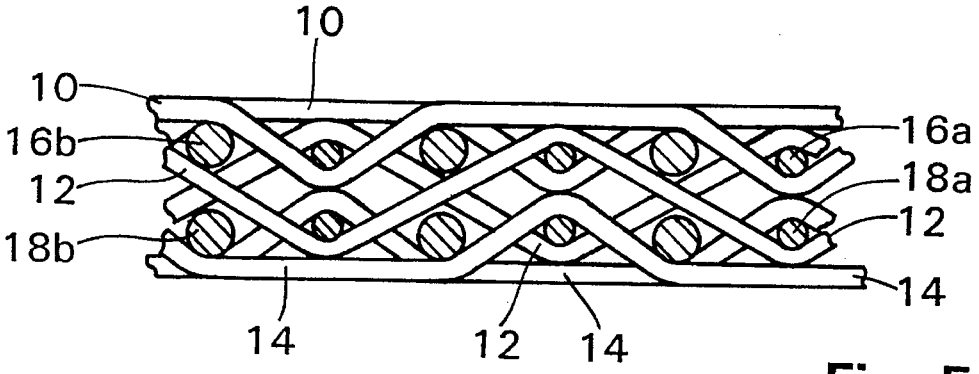
FIG. 5 is a schematic view of a second embodiment of a fabric having three layers of stacked MD yarns.

Preferably the CMD yarns are either all the same size as depicted in FIG. 2 or alternate in size as depicted in FIG. 5, where the crimped CMD yarns 16*a*, 18*a* are smaller in diameter than the relatively non-crimped CMD yarns 16*b*, 18*b*. Using different diameter CMD yarns permits the fabric 2 to maintain a uniform caliper while retaining respective pairs of CMD yarns 16*a,b*, 18*a,b* in vertical alignment. The crimp of the CMD yarns 16*a*, 18*a* around which the upper and lower MD yarns 10, 14 form knuckles is greater for the relatively small diameter CMD yarns of the FIG. 5 embodiment as compared to the fabric embodiment depicted in FIGS. 2–4. In both cases, the alternate CMD yarn pairs 16*b*, 18*b* exhibit virtually no crimp. Further details of such a preferred fabric are described in U.S. Pat. No. 5,343,896 which is incorporated herein by reference as if fully set forth.

Figure 6A:
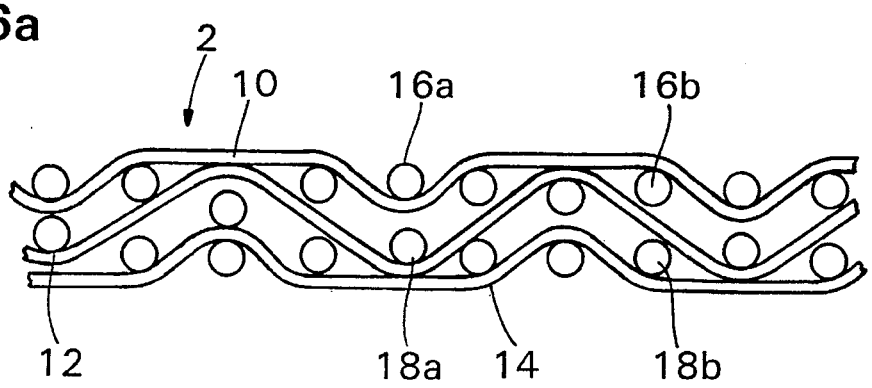
FIGS. 6*a*, 6*b*, 6*c* and 6*d* are a series of illustrations showing the formation of a double loop seam for the papermakers fabric depicted in FIGS. 2–5.
Figure 6B:
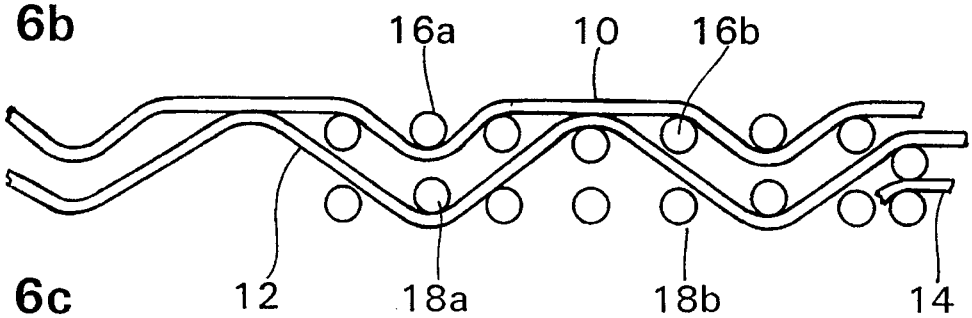

With reference to FIGS. 6*a–d*, the formation of the orthogonal seaming loops 5 and spaces 6 for the respective fabric ends is illustrated. After the fabric has been woven and heat set, it is cut to a desired length as illustrated in FIG. 6*a*. CMD yarns are then removed from the end of fabric 2 leaving end portions of the crimped MD yarns 10, 12, 14 projecting from the end of the fabric. The lower layer MD yarns 14 are trimmed back into the fabric to provide space for the back weaving of the upper MD yarns 10, as shown in FIG. 6*b*.

Figure 6C:
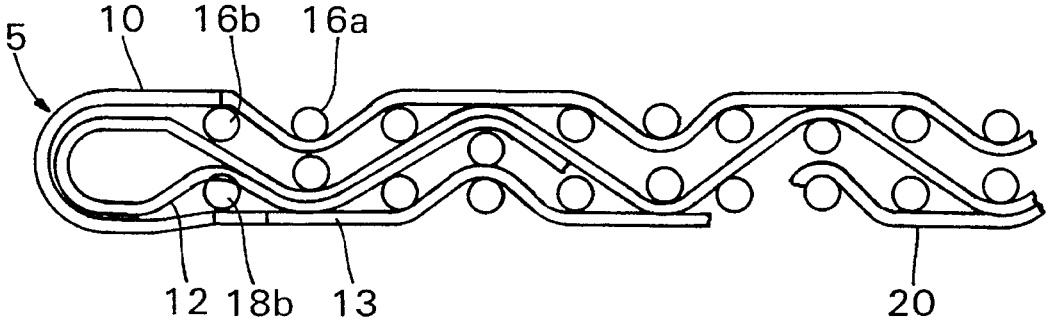
Figure 6D:
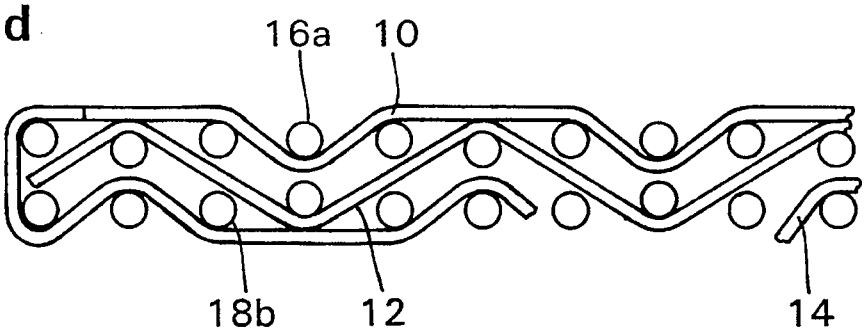

FIGS. 6*c* and 6*d* illustrate the different treatment of alternate groups of stacked MD yarns. With respect to the loop forming MD yarn groups, the projecting end of intermediate yarn 12 is looped back and rewoven with itself. The upper MD yarn 10 is then looped back and rewoven in the space vacated by lower MD yarn 14 to form a double nested loop as shown in FIG. 6*c*.

Alternatively, the inner loops formed by the intermediate yarns 12 may instead be formed by pre-crimped yarn segments as illustrated below in conjunction with the embodiment of FIG. 13. In such case, the intermediate MD yarns 12 are trimmed back into the fabric and the loop forming yarn segments are backwoven in the space vacated by trimming the intermediate MD yarns 12. A preferred method of forming such pre-crimped yarn segments is set forth in U.S. Pat. No. 5,411,062 which patent is incorporated herein by reference as if fully set forth.

Preferably, an inner loop is-formed with respect to each outer loop so that all of the end loops are double loops. However, it will be recognized by those skilled in the art, that providing inner loops for only half of the outer loops or less will still result in a substantially more durable seam.

With respect to the non-loop forming MD groups, the middle MD yarn 12 is trimmed back to the end most remaining CMD yarns and the projecting end of MD yarn 10 is looped back and rewoven in the space vacated by lower MD yarn 14 to retain the end most CMD yarns within the fabric, as illustrated in FIG. 6*d*. Alternatively, a single CMD yarn 18*a*, not shown, may be used as the end most CMD yarn in order to match the preexisting crimp of the projecting MD yarn ends to the backweaving pattern.

In the preferred embodiment, the upper MD yarns 10 are woven 100% warp fill and the crowding of the yarns maintains the orthogonal orientation of the seaming loops. Preferably, loop forming yarns 10 and 12 are all backwoven approximately 2 to 2½ inches or between 32 and 40 picks within the fabric in order to provide sufficient strength to prevent the loops from being pulled apart during normal usage. If the fabric is woven less than 100% warp fill, the loop forming yarns 10 and 12 should be backwoven a greater distance to maintain the integrity of the fabric. Non-loop forming MD yarns 10 are backwoven a shorter distance since no load is imparted to those yarns during usage. Where the warp fill of the MD layers is 50% or less, there is no necessity for providing non-loop forming yarns since the spacing between the MD yarns may provide sufficient space to intermesh loops formed from all of the upper layer MD yarns.

Figure 7:
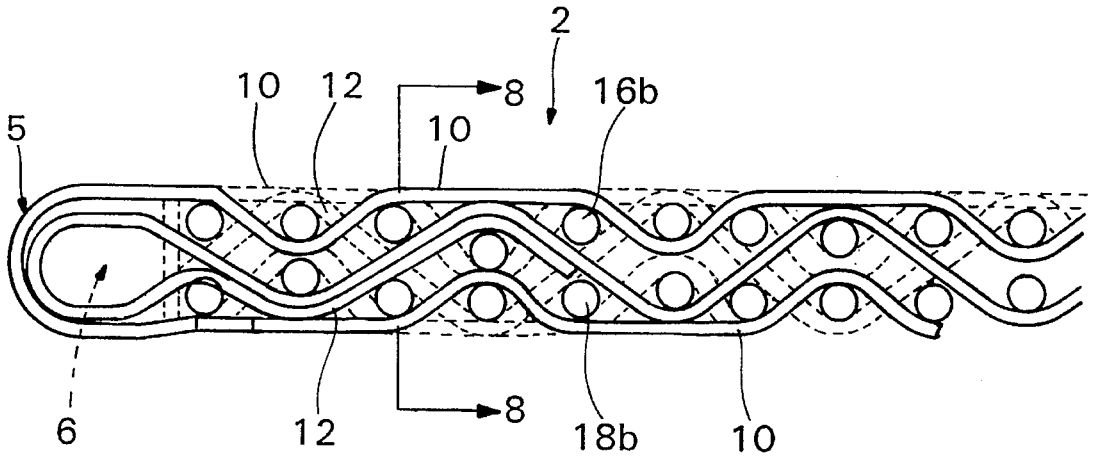
FIG. 7 is a composite view of the fabric end depicted in FIGS. 6*c–d* showing the loop forming MD yarns and, in phantom, the non-loop forming MD yarns.
Figure 8:
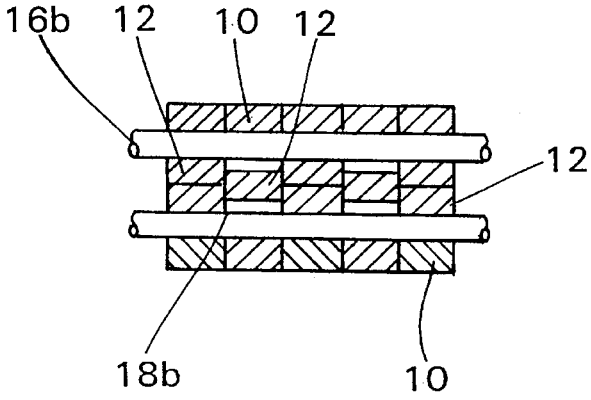
FIG. 8 is a cross sectional view along line 8—8 in FIG. 7.

FIGS. 7 and 8 illustrate the finished loop construction for one seam end of the papermakers fabric 2; the group of stacked loop forming MD yarns shown in solid and the group of non-loop forming MD yarns shown in phantom. The doubling of the middle MD layer yarns 12 which form loops does not significantly add to the caliper of the seam since the CMD yarns tend to become offset as illustrated in FIG. 2. Where the fabric 2 is configured with different size CMD yarns 16*a*, 18*a* and 16*b*, 18*b*, as shown in FIG. 5, yarns having the same diameter as the smaller diameter yarns 16*a*, 18*a* can be substituted for the larger, relatively non-crimped CMD yarns 16*b*, 18*b* to maintain both vertical alignment and stacking of the CMD yarns without any significant increase in fabric caliper at the seam.

Figure 15:
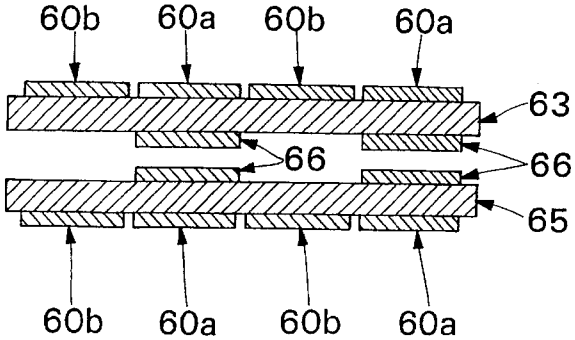
FIG. 15 is a cross sectional view along line 15—15 of FIG. 13.

A nested double loop seam can also be provided where the fabric 2 has a single layer of CMD yarns and pairs of upper and lower stacked MD yarns. Such fabrics are disclosed in detail in U.S. Pat. No. 5,343,896. FIGS. 9–12 depict one type of double loop nested seam and FIGS. 13–15 depict an alternate seam for a single CMD layer fabric.

Referring to the embodiment shown in FIGS. 9–12, a single layer fabric 30 has alternating stacked pairs of upper layer MD yarns 40*a,b* and lower MD yarns 42*a,b*. The stacked MD yarns are interwoven with a single layer of CMD yarns comprised of alternating smaller diameter yarns 41*a* and larger diameter yarns 41*b*. The MD yarns weave knuckles around the smaller diameter yarns 41*a* as explained in further detail in U.S. Pat. No. 5,343,896.

In creating the seaming end of the fabric, the fabric is initially woven, heat set, and cut to a desired length. As in the multiple CMD layer embodiment, CMD yarns are removed to leave the crimped MD yarns projecting from the end of the fabric 30. With respect to the groups of non-loop forming MD yarns 40*a*, 42*a*, the lower layer yarn of 42*a* is trimmed back within the fabric and the upper layer MD yarn 40*a* is backwoven within the fabric to retain the end most CMD yarn 45, as illustrated in FIG. 9*a*. With respect to the loop forming groups of MD yarns 40*b*, 42*b*, the lower MD yarn 42*b* is looped back upon itself and woven directly beneath and in contact with the upper MD yarn 40*b*. The projecting end of the upper MD yarn 40*b* is then looped back and woven directly beneath and in contact with lower MD yarn 42*b*.

Preferably, the MD yarns are relatively thin high aspect ratio yarns. Accordingly, there is only a small increase in caliper in the seam area of the fabric. This increase in caliper can be modified through the replacement of the CMD yarns 41*b* with yarns approximately the same diameter of the smaller diameter CMD yarns 41*a*. Preferably the MD yarns 40*b*, 42*b* are backwoven between 2 to 2½ inches or 32 to 40 picks into the end of the fabric to maintain the integrity of the fabric ends.

Figure 13:
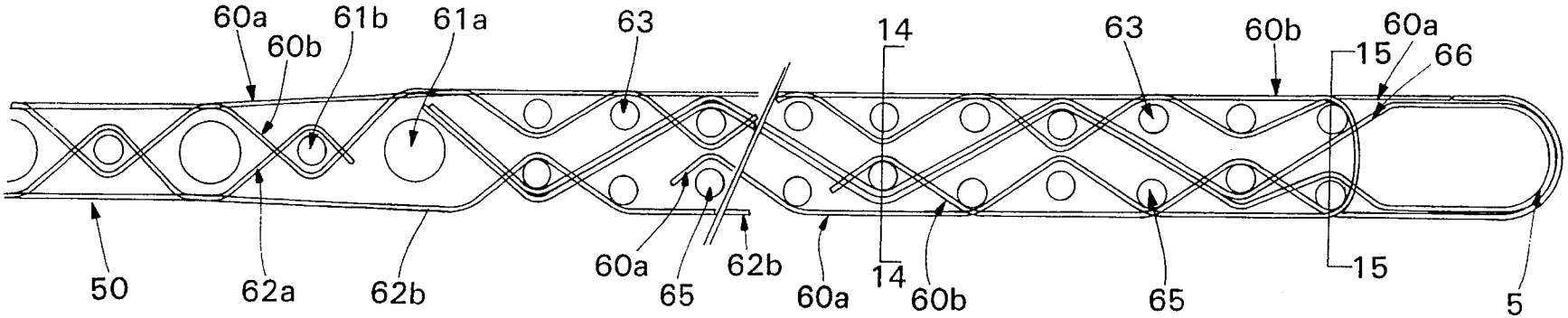
FIG. 13 is a schematic view of a fourth embodiment of a fabric having a double to single CMD layer transition proximate the ends of the fabric.
Figure 14:
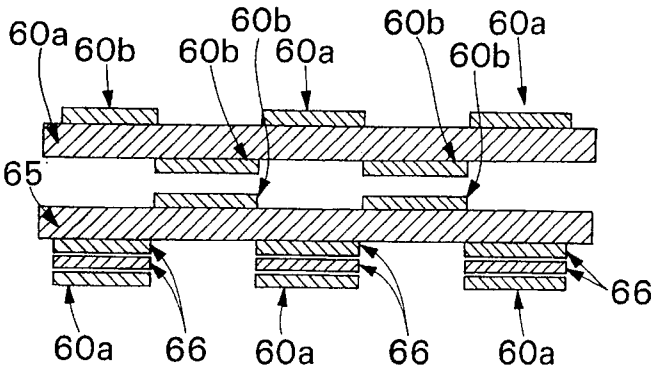
FIG. 14 is a cross sectional view along line 14—14 of FIG. 13.

With reference to FIGS. 13–15 there is shown a hybrid construction where the seam for the double CMD yarn layer fabric is used for a single CMD layer fabric. In this embodiment, upper layer MD yarns 60*a,b* and lower layer MD yarn 62*a,b* are interwoven in the body of the fabric 50 with single layer CMD yarns 61*a,b*, 61*a,b*. After the fabric is cut to desired length and a selected number of end most CMD yarns 61*a*, 61*b* are removed, the upper and lower MD yarns 60*a,b*, 62*a,b* are woven with stacked pairs of CMD yarns 63, 65 in the same repeat pattern as the upper and lower MD yarns illustrated in FIGS. 2–5 above with respect to the fabric having three layers of stacked MD yarns. Between the stacked MD yarn pairs 60*a*, 62*a*is interwoven a doubled yarn segment 66 which forms the interior loop of the doubled end loops 5. The interior MD yarn segment 66 is pre-crimped to match the double CMD layer weave pattern either through manual crimping or from being a portion of a middle MD yarn removed from a previously woven and heat set fabric of the type illustrated in FIG. 2 or 5 above. The outer nested loop is formed from the upper layer MD yarn 60*a* as discussed above.

Preferably, MD yarns 60*a* are backwoven between 2 and 4 inches into the double CMD layer end of the fabric in order to maintain the integrity of the fabric. The non-loop forming MD yarns 62*a* may be backwoven to a lesser degree.

With respect to the yarns employed in the present invention, it is preferred to utilize continuous monofilament yarns. However, multifilament yarns, particularly for the CMD yarns, may be utilized. With respect to the non-crimped CMD "stuffer" yarns, it will be recognized that the stuffers may be of the same material as the remainder of the fabric or may be selected for certain characteristics. Those skilled in the art will recognize that stuffer yarns are often spun yarns which are selected to achieve certain characteristics of permeability and density in the fabric body and/or seam area.

Figure 16:
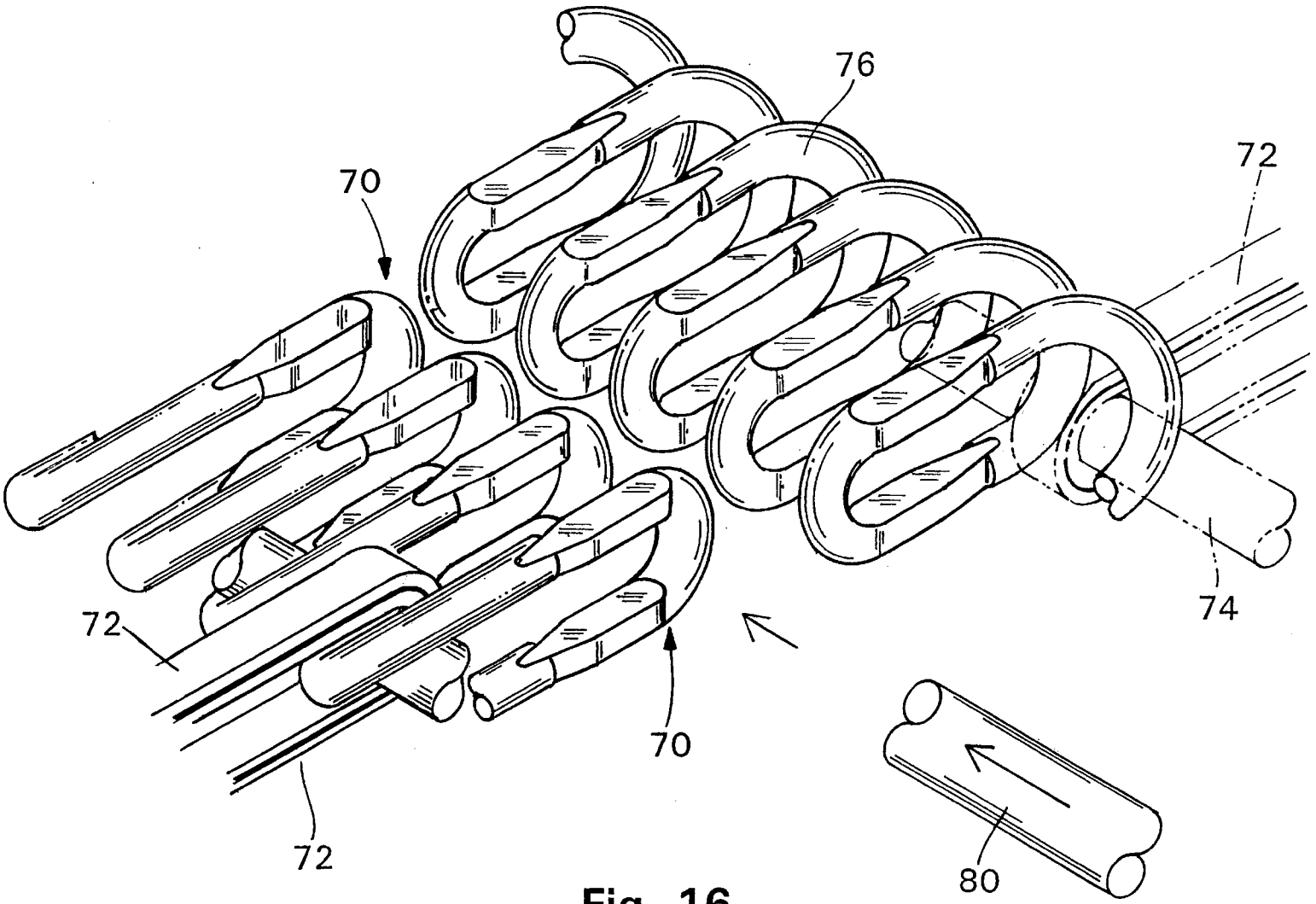
FIG. 16 is a schematic view of a thin line coil connection between the opposing ends of the fabric.

As shown in FIG. 16, a thin line coil 76 may be used in conjunction with the doubled end loop to secure the fabric ends together. With respect to attachment of the coil members to the fabric body, this attachment is accomplished in substantially the same manner as that utilized by the prior art to form a pin seam such as disclosed in U.S. Pat. No. 4,862,926 which is incorporated by reference as if fully set forth.

In this embodiment, the machine direction loops form binding loops which secure the coil 70 member to the fabric body. Thus, the seam construction is strengthened through the utilization of twice as many machine direction yarns. This doubling of machine direction yarns is accomplished without any sacrifice in the quality of the seam. The machine direction yarns 72 which are utilized to form the binding loops 72 for the coil members 70 are twinned or paired and are positioned between and over the angular headcurves.

Although it is possible to attach the coil member 70 to the fabric body solely through the use of loop yarns 72, it is preferred that a tying yarn or pintle 74 be inserted within and adjacent to the angular headcurves 76. The loop yarns 72 extend between the angular headcurves around the tying wire or pintle 74 and weave back into the body of the fabric in the usual manner of a pin seam. The pintle 74 has a non-circular configuration and is generally oval in configuration. Alteratively, the pintle may be round, rectangular, bone shaped or of other configurations. Some suitable configurations for the pintle are shown in U.S. Pat. No. 4,862,926. Through the utilization of this construction, it is possible to equalize the tension placed on the respective angular headcurves 76. Since the tying wire or pintle 74 is under the influence of all the loops 72, unequal tensions at various points on the coil member 70 will be avoided. A larger pintle 80 is utilized to connect the coils together. The attachment of the coil members and the weaving back into the fabric body of the machine direction yarns forming loops 72 may be accomplished with a shed forming machine which will be known to those skilled in the art.

While the present invention has been described in terms of the preferred embodiment, other variations which are within the scope of the invention as defined in the claims will be apparent to those skilled in the art.

We claim:

1. A papermakers fabric comprising a woven fabric body having opposing ends, said fabric body having a system of MD yarns interwoven with a system of CMD yarns; on each end of the fabric, at least some of said MD yarns forming a first series of end loops; and a second series of loops formed concentric with at least some of said first series loops to define with said first series loops, double end loops on at least one end of said fabric for facilitating seaming the fabric ends together.

2. The papermakers fabric of claim 1 wherein said first series loops comprise outer loops and said second series loops comprise inner loops nested within said outer loops of said double end loops.

3. The papermakers fabric of claim 2 wherein said system of MD yarns comprises at least two layers of stacked flat MD yarns and said first series loops are all formed from MD yarns of a first layer of MD yarns.

4. The papermakers fabric of claim 3 wherein said double end loops are formed on both ends of said fabric.

5. The papermakers fabric of claim 3 wherein said first series loops are formed from every other MD yarn of said first layer of MD yarns and said second series loops are formed from every other MD yarn of a second layer of said MD yarn system such that each first series loop is paired with a second series loop to form a series of uniformly spaced double end loops on the fabric end.

6. The papermakers fabric of claim 3 wherein said second series loops are formed from selected MD yarns of a second layer of said MD yarn system.

7. The papermakers fabric of claim 3 wherein said second series loops are formed from pre-crimped yarn segments.

8. The papermakers fabric of claim 3 wherein at least one layer of said MD yarns is woven at 100% warp fill.

9. The papermakers fabric of claim 3 wherein said first series loops are interwoven in spaces vacated by trimming selected MD yarns back a selected distance within said end of said fabric.

10. The papermakers fabric of claim 3 wherein said end loop yarns are backwoven between 2 and 2-½ inches into the fabric.

11. The papermakers fabric of claim 3 wherein said CMD yarn system is a single layer of CMD yarns and said end loop yarns are backwoven from 32 to 40 CMD yarns within the fabric.

12. The papermakers fabric of claim 2 wherein said system of MD yarns is comprised of at least three layers of stacked flat MD yarns and said first series loops are formed from MD yarns of a first layer of MD yarns.

13. The papermakers fabric of claim 12 wherein said second series loops are formed from selected MD yarns of a second layer of said MD yarn system.

14. The papermakers fabric of claim 13 wherein said first series loops are interwoven in spaces vacated by trimming selected MD yarns of a third MD layer back a selected distance within said end of said fabric.

15. The papermakers fabric of claim 12 wherein said second series loops are formed from pre-crimped yarn segments and are interwoven in spaces vacated by trimming selected MD yarns back a selected distance within said end of said fabric.

16. The papermakers fabric of claim 12 wherein at least one layer of said MD yarns is woven at 100% warp fill.

17. The papermakers fabric of claim 12 wherein said CMD yarn system is a double layer of CMD yarns and said end loop yarns are backwoven from 64 to 80 CMD yarns within the fabric.

18. The papermakers fabric of claim 1 wherein said double end loops are formed on both ends of said fabric and each first series loop is paired with a second series loop such that all of the seam forming end loops are double end loops.

19. The papermakers fabric of claim 1 wherein the end loops of said opposing fabric ends are intermeshed to define an intersecting channel and a pintle is disposed within the channel defined by said intermeshed loops.

20. The papermakers fabric of claim 1 further comprising thin line coils secured to the end loops of said opposing fabric ends.

21. The papermakers fabric of claim 1 wherein said second series loops are formed from selected MD yarns of said MD yarn system.

22. The papermakers fabric of claim 1 wherein said second series loops are formed from yarn segments backwoven into the fabric end.

23. A method for forming seaming loops on opposing fabric ends of a woven papermakers fabric comprising the steps of:

forming an inner series of end loops through backweaving yarns into the fabric, and forming an outer series of end loops concentric with said inner loops to define a series of double loops using selected MD yarns extending from the fabric ends, and backweaving said selected MD yarns into the fabric.

24. The method according to claim 23 wherein said fabric is formed from stacked MD yarn layers and said inner loops are formed by backweaving selected MD yarns into the end of the fabric.

25. The method according to claim 23 wherein said inner loops are formed by backweaving pre-crimped yarn segments into the end of the fabric.

26. The method according to claim 23 where said fabric is formed from a system of MD yarns comprising at least two layers of stacked flat MD yarns and a single layer of CMD yarns wherein:

said inner loops are formed first by backweaving selected MD yarns of a first layer of MD yarns; and said outer loops are then formed by backweaving selected MD yarns of a second layer of MD yarns.

27. The method according to claim 23 where said fabric is formed from a system of MD yarns comprising at least three layers of stacked flat MD yarns wherein:

said inner loops are formed first by backweaving MD yarns of a middle layer of MD yarns in contact with themselves; and said outer loops are then formed by backweaving MD yarns of an upper layer of MD yarns into spaces vacated by trimming MD yarns of a lower layer of MD yarns.

* * * * *